US007821480B2

(12) United States Patent
Peron et al.

(10) Patent No.: US 7,821,480 B2
(45) Date of Patent: Oct. 26, 2010

(54) CHARGE TRANSFER CIRCUIT AND METHOD FOR AN LCD SCREEN

(75) Inventors: Benoît Peron, Tours (FR); Francis Cuellar, La Croix en Touraine (FR)

(73) Assignee: STMicroelectronics SA, Montrouge (FR)

( * ) Notice: Subject to any disclaimer, the term of this patent is extended or adjusted under 35 U.S.C. 154(b) by 630 days.

(21) Appl. No.: 11/648,173

(22) Filed: Dec. 29, 2006

(65) Prior Publication Data

US 2007/0188437 A1 Aug. 16, 2007

(30) Foreign Application Priority Data

Dec. 29, 2005 (FR) ..... 05 54130

(51) Int. Cl.
*G09G 3/36* (2006.01)

(52) U.S. Cl. ..... 345/87; 345/94; 345/95; 345/96

(58) Field of Classification Search ..... 345/94–96
See application file for complete search history.

(56) References Cited

U.S. PATENT DOCUMENTS 3,509,374 A * 4/1970 Lockshaw ..... 327/389
5,717,437 A 2/1998 Sano et al.
5,821,923 A 10/1998 Van Amesfoort et al.
5,914,588 A * 6/1999 Jiang ..... 323/267
5,936,598 A * 8/1999 Hayama et al. ..... 345/76
5,943,030 A 8/1999 Minamibayashi et al.
6,064,158 A 5/2000 Kishita et al.
6,160,531 A * 12/2000 Chen et al. ..... 345/60
7,151,518 B2 * 12/2006 Fukumoto et al. ..... 345/96
7,310,076 B2 * 12/2007 Suzuki et al. ..... 345/76
7,391,401 B2 * 6/2008 Kim et al. ..... 345/96
2001/0029102 A1 * 10/2001 Okamura et al. ..... 438/689
2006/0290631 A1 * 12/2006 Chen et al. ..... 345/92

OTHER PUBLICATIONS

French Search Report, FR0554130, Aug. 4, 2006.

* cited by examiner

*Primary Examiner*—Richard Hjerpe
*Assistant Examiner*—Jeffrey S Steinberg
(74) *Attorney, Agent, or Firm*—Lisa K. Jorgenson; Paul F. Rusyn; Graybeal Jackson LLP

(57) ABSTRACT

A charge transfer circuit of a liquid crystal display includes at least one inductive element connectable between first and second common terminals, to a first and to a second groups of lines of the display, respectively.

14 Claims, 3 Drawing Sheets

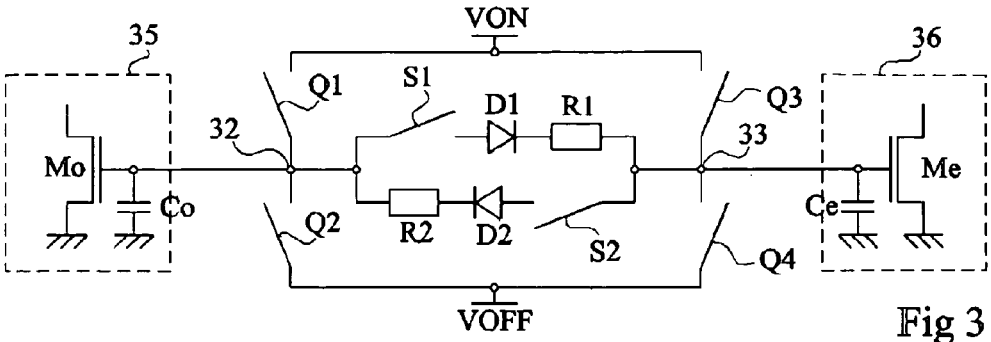
Fig 3
(Background Art)
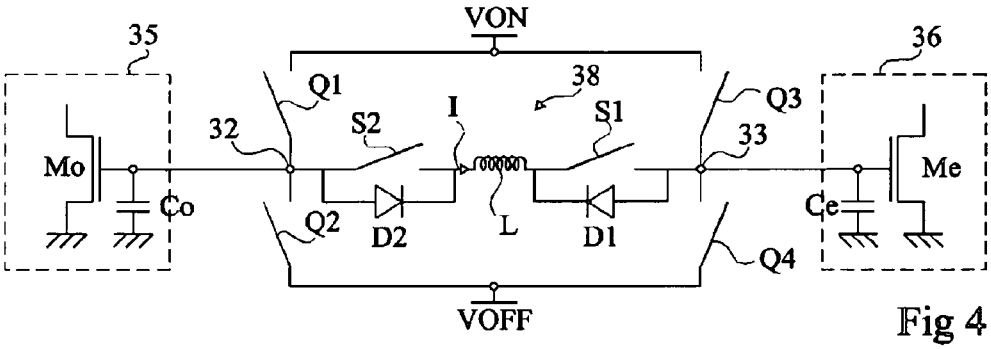
Fig 4
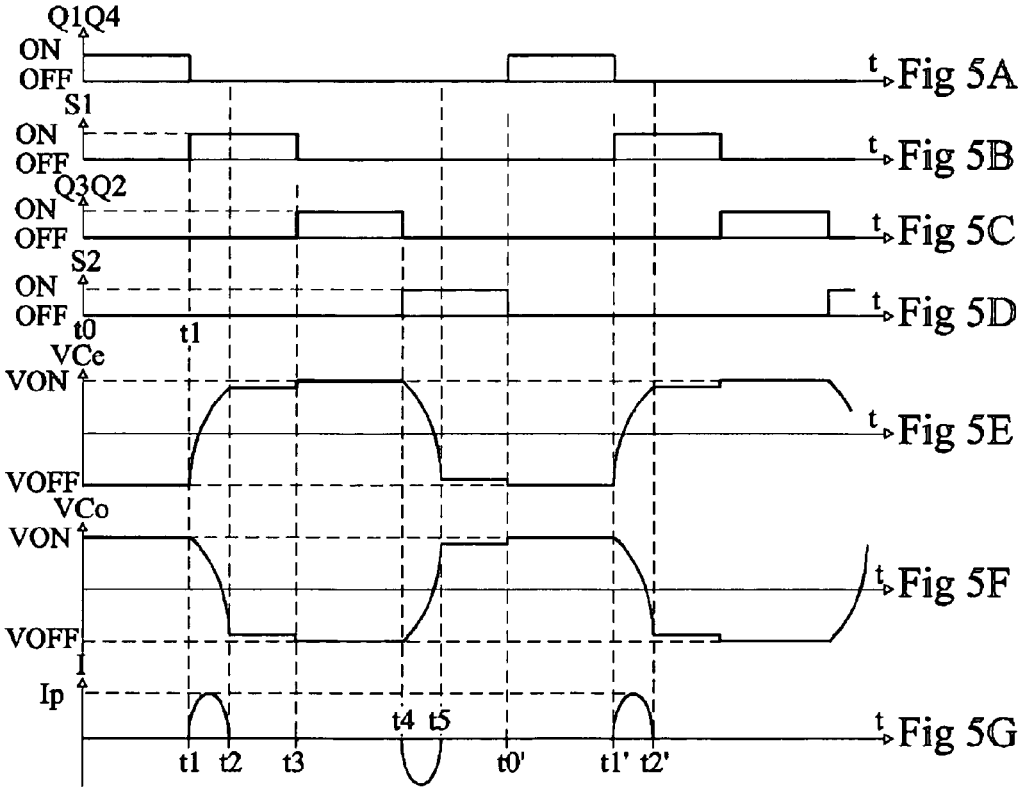

CHARGE TRANSFER CIRCUIT AND METHOD FOR AN LCD SCREEN

PRIORITY CLAIM

The present application claims the benefit of French patent application Ser. No. 05/54130, filed Dec. 29, 2005, which application is incorporated herein by reference in its entirety.

1. Technical Field

Embodiments of the present invention generally relate to liquid crystal display screens (LCD) and, more specifically, to circuits for controlling such screens.

2. Discussion of the Related Art

FIG. 1 partially and very schematically shows a pixel 1 of a monochrome LCD screen or a sub-pixel of a color LCD screen. Electrically, each pixel 1 is formed of a control switch M (typically, a MOS transistor) and of a capacitor C1, as a memory cell. A first conduction terminal of switch M is connected to a column conductor Col, common to all the switches of the display panel column. The other conduction terminal is connected to a first electrode of capacitor C1 of the pixel, having its second electrode connected to ground, the dielectric of capacitor C1 being formed of the liquid crystal used for the display. The gates of switches M are connected, in rows, to line conductors Row. The presence of switch M generates a capacitive element C between its gate and its source, and thus between line Row and the first electrode of capacitance C1 of cell 1. Columns conductors Col are controlled by a column driver circuit 2 (CDRIVER) generally setting the luminance reference values while row conductors Row are controlled in scan mode by a row driver circuit 3 (GDRIVER).

For a color screen, each cell 1 forms a sub-pixel and the color is provided by a corresponding chromatic filter (RGB) arranged in front of each sub-pixel.

FIG. 2 partially and schematically shows the equivalent electric diagram of a liquid crystal display panel 10 and of its row control circuit In the example of FIG. 2, only two columns $Col_i$ and $Col_{i+1}$ have been shown. Similarly, only five rows $Row_1$, $Row_2$, $Row_3$, $Row_{n-1}$, and $Row_n$ have been shown. The screen integration on a substrate generally made of glass is no longer limited to the cells but also involves the row control circuits. These circuits comprise, for each row, an RS-type flip-flop B1, B2, B3 . . . , Bn-1, and Bn, the direct Q output of which is used to control a switch K1, K2, K3, Kn-1, Kn placed on each row conductor to bring a supply voltage onto it. The S activation input of first flip-flop B1 receives a scan start signal Start. The S activation input of flip-flop B2 is connected to line $Row_1$, downstream of switch K1 with respect to the supply source. The S activation input of flip-flop B3 is connected to line $Row_2$, downstream of switch K2, etc. until the S activation input of the last flip-flop Bn connected to line $Row_{n-1}$. The R reset inputs of the flip-flops are respectively connected to the conductor of the row of next rank, downstream of the corresponding switch K, until the R input of the last flip-flop Bn which is looped back on row $Row_1$.

The line powering is generally performed by a line scanning. The rows of odd rank $Row_1$, $Row_3$, . . . , $Row_{n-1}$ are interconnected upstream of switches K1, K3, . . . Kn-1 to a terminal 32 while the lines of even rank $Row_2$, . . . $Row_n$ are, upstream of their respective switches, connected to a terminal 33. Terminals 32 and 33 are respectively connected to the junction points of pairs of switches Q1 and Q2, respectively Q3 and Q4, series-connected between terminals of application of respectively high and low turn-on and turn-off voltages $V_{ON}$ and $V_{OFF}$.

The scanning is performed by lines, starting, for example, with an odd line by turning on switches Q1 and Q4 and by turning off switches Q2 and Q3 for both supplying this odd line and forcing the turning-off of the even line of next rank. Signal Start applied on the S activation input of first flip-flop B1 enables automatic row scanning. The addressing of an even row is performed symmetrically by turning off switches Q1 and Q4 and by turning on switches Q2 and Q3. The switching of switches Q1 to Q4 is thus performed at the rate of the line scanning under control of a circuit 5 (CTRL).

A problem is that the series associations of elements C and C1 of all columns of a row are in parallel and have a charge opposite to that of the next row.

To avoid too high a power loss, a charge recovery stage is generally provided, thus enabling, for each column, using the power stored in the pixels to be turned off of the row which has just been addressed to help the turning-on of the pixels of the next line. For this purpose, terminals 32 and 33 are generally connected by an assembly of two diodes in ant-parallel D1 and D2, each in series with a resistor R1 and R2 and a switch S1 and S2.

FIG. 3 shows an equivalent simplified electric diagram of FIG. 2 enabling better illustrating the operation of the H bridge formed of switches Q1, Q2, Q3, and Q4 and the charge transfer circuits formed of switches S1, S2 and of their diodes and resistors in series. The assembly of the cells of an odd line of the panel has been symbolized by a block 35, a switch Mo, and an equivalent capacitance $$Co\left(\frac{1}{Co} = \sum\left(\frac{1}{C} + \frac{1}{C1}\right),\right.$$

the sum comprising all the cells in the odd row). The assembly of the cells of the even rows has been symbolized by a block 36, a switch Me and an equivalent capacitance $$Ce\left(\frac{1}{Ce} = \sum\left(\frac{1}{C} + \frac{1}{C1}\right),\right.$$

the sum comprising all the cells in the even row). For simplification, the flip-flops used for the scanning have not been illustrated in FIG. 3. These flip-flops are in practice interposed between each terminal 32 and 33 and the odd and even lines of blocks 35 and 36.

For the turning-on of the pixels of the first odd line, switches Q1 and Q4 are turned on, which causes the application of a voltage $V_{ON}$ on terminal 32 and $V_{OFF}$ on terminal 33. A current can then flow to charge the capacitances of pixels of this first line. At the end of this addressing period, transistors Q1 and Q4 are turned off and switch S1 is turned on for a so-called power recovery or transfer phase, which enables precharging the next line (even) by the discharge of the odd line which has just been addressed. This phase places the first odd and even lines in an intermediary equilibrium voltage. Then, switches Q2 and Q3 are turned on to bring the voltage of the even line to level $V_{ON}$ and end the discharge of the first odd line to level $V_{OFF}$. At the end of the turning-on of the even line, switches Q2 and Q3 are turned off and switch S2 is turned on to enable precharge of the next odd line and thus resume the operation by turning-on of switches Q1 and Q4.

With known LCD screens or panels, losses remain high even with the charge transfer stages. For example, for a screen having its assemblies of even and odd lines respectively exhibiting equivalent 4.7-nF capacitances Ceq=Co=Ce, with a line scanning at a 166-kHz frequency f with a 35-volt turn-on voltage $V_{ON}$ and a −25-volt turn-off voltage $V_{OFF}$, losses amount to approximately 1.4 watts ($f*Ceq(V_{ON}-V_{OFF})^2/2$).

Furthermore, with known displays the control of the switches S1 and S2 of the charge recovery stages is generally complex, due to the floating voltages of the terminals of these switches.

SUMMARY OF THE INVENTION

Embodiments of the present invention improve the control of flat screens, especially with liquid crystals, with a charge transfer stage to decrease the power losses of such screens.

The control of the switches of charge transfer stages may also be simplified.

One embodiment of the present invention provides a liquid crystal display charge transfer circuit including at least one inductive element connectable between a first and a second common terminal, respectively, to a first and to a second group of lines of the display.

According to an embodiment of the present invention, said terminals are connected to the respective junction points of switches connected, in pairs, in series between third and fourth terminals of application of high and low line supply voltages.

According to an embodiment of the present invention, the circuit comprises two switches respectively in parallel with a diode, these parallel associations being in series between said first and second terminals, and said inductive element being interposed between the two switches.

According to an embodiment of the present invention, each switch has a first conduction terminal connected to the inductive element and its control terminal connected to its second conduction terminal by a parallel association of a resistive element, of a capacitive element, and of a voltage-limiting element, the control terminal of each switch being further respectively connected to the midpoints of series associations of diodes connected between a fifth terminal of provision of a control current and said third terminal of application of the high line supply voltage.

According to an embodiment of the present invention, said control current is provided by a current source connected via a third switch to said fifth terminal.

According to an embodiment of the present invention, said capacitive element comprises the gate-source capacitance of a MOS transistor forming the corresponding switch.

Embodiments of the present invention also provide a circuit for controlling a liquid crystal display.

Embodiments of the present invention include a circuit for controlling a liquid crystal display and may also include such a control circuit in a flat liquid crystal display.

Embodiments of the present invention will be discussed in detail in the following non-limiting description of example embodiments in connection with the accompanying drawings.

BRIEF DESCRIPTION OF THE DRAWINGS

FIG. 3, previously described, shows a simplified electric diagram of the supply and charge transfer circuit of FIG. 2;

FIG. 4 very schematically and partially shows a power supply circuit of a liquid crystal display according to an embodiment of the present invention;

FIGS. 5A, 5B, 5C, 5D, 5E, 5F, and 5G are examples of timing diagrams illustrating the operation of the circuit of FIG. 4;

DETAILED DESCRIPTION

The following discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
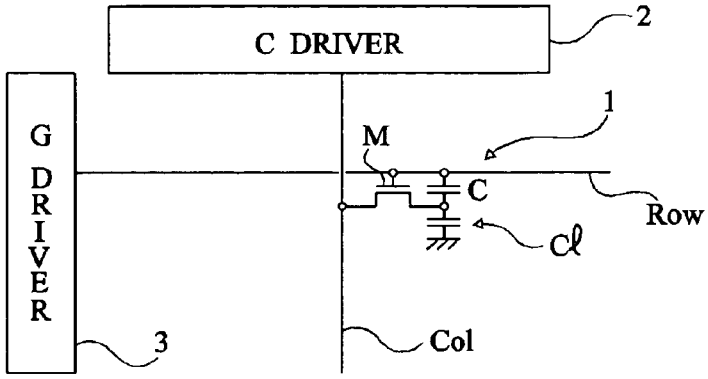
Fig 1 (Background Art)
FIG. 1, previously described, very schematically and partially shows a liquid crystal display to which embodiments of the present invention apply.
Figure 2:
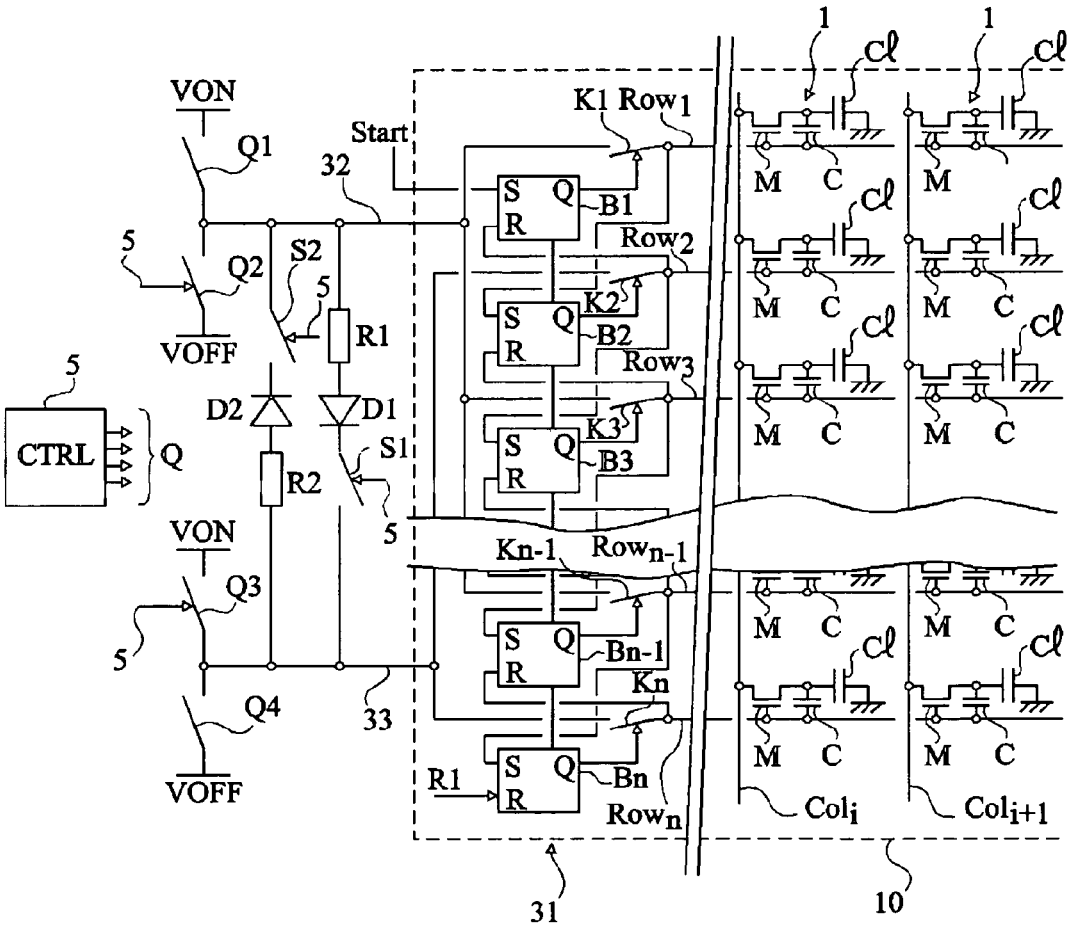
Fig 2 (Background Art)
FIG. 2, previously described, shows an equivalent electric diagram of a liquid crystal display and of a conventional line control circuit with a supply and charge transfer stage.

The same elements have been designated with the same reference numerals in the different drawings. For clarity, only those control steps and elements which are necessary to the understanding of embodiments of the present invention have been shown in the drawings and will be described hereafter. In particular, the provision of the different luminance control signals brought by the column control circuits has not been detailed, since embodiments of the present invention involve no necessary modifications of these circuits. The same is true for the line scanning performed by a conventional circuit (for example, of the type described in relation with FIG. 2).

A feature of an embodiment of the present invention is to use an inductive element in the charge transfer stage of the display.

FIG. 4 shows an embodiment of the present invention. This drawing shows the equivalent electric diagram of a liquid crystal display in a representation to be compared with that of previously-described FIG. 3.

The assembly of cells of a line of odd rank is symbolized by a block 35, a switch Mo, and an equivalent capacitor Co. The assembly of cells of a line of even rank is symbolized by a block 36, a switch Me, and an equivalent capacitance Ce. As previously described, the line conductors are connected via scan switches (not shown) to common points, respectively 32 for odd lines and 33 for even lines. For simplification, the scan circuit has not been illustrated in FIG. 4. Points 32 and 33 are connected to the junction points of switches Q1 and Q2 and switches Q3 and Q4, respectively, between two terminals of application of respectively high and low supply voltages $V_{ON}$ and $V_{OFF}$.

According to this embodiment of the present invention, charge transfer stage 38 connecting terminals 32 and 33 to form, with switches Q1 to Q4, an H bridge, comprises two switches S1 and S2 in series and between which an inductive element L is interposed, each switch being in parallel with diodes D1, D2 having anodes connected to terminals 33, and 32, respectively.

An inductance L made of ferrite may be used to optimize the loss reduction.

FIGS. 5A, 5B, 5C, 5D, 5E, 5F, and 5G are timing diagrams illustrating, in examples of shapes of control signals of switches Q1 and Q4, of switch S1, switches Q2 and Q3, of switch S2, and in examples of shapes of voltages VCe and VCo across equivalent capacitors Ce and Co of the cells of an even and odd line, respectively, as well as in an example of shape of current I in the charge transfer stage, the operation of the circuit of FIG. 4.

As previously, the turning-on of the first odd line starts with a turning-on of switches Q1 and Q4 (time t0), with switches Q2 and Q3 as well as switches S1 and S2 being off. Voltage VCo is then brought to level $V_{ON}$ and voltage VCe is brought to level $V_{OFF}$. The luminance reference values are provided by the column control circuit (not shown). In the indicated voltage levels, the influences of the different voltage drops of the switching elements in the ON state are neglected.

At a time t1, subsequent to the end of the addressing of the first odd line, switches Q1 and Q4 are turned off and switch S1 is turned on to precharge the first even line by flowing of a current through diode D2, inductance L, and switch S1. The current through inductance L increases up to a maximum Ip before canceling at a time t2. Between times t1 and t2, voltage VCe switches from level $V_{OFF}$ to a level dose to level $V_{ON}$ and voltage VCo switches from level $V_{ON}$ to a level dose to level $V_{OFF}$. The interval between times t1 and t2 is a function of equivalent capacitance Co and of the value of inductance $$L\left(t2 - t1 = \frac{\pi}{\sqrt{2}} \cdot \sqrt{Co \cdot L}\right).$$

The maximum current Ip also depends on equivalent capacitance Co and on inductance L and is equal to $V_{ON}$-$V_{OFF}$·$\sqrt{Co/2L}$.

From a time t3, subsequent to time t2, switch S1 is off and switches Q3 and Q2 are on to complete the charge of the cells of the even line (voltage VCe) to level $V_{ON}$ and end the discharge of the cells of the odd line (voltage VCo) to level $V_{OFF}$. The addressing of the cells of the first even line is performed during this phase.

At the end of this addressing phase (time t4), switch S2 is turned on while switches Q2 and Q3 are off to cause a precharge of the cells of the next odd line. A current then flows through diode D1, inductance L, and switch S2. This current is of course in reverse direction with respect to the current between times t1 and t2. It also has a non-linear increase and decrease and a peak value $V_{ON}$-$V_{OFF}$·$\sqrt{Ce/2L}$ which is a function of equivalent capacitance Ce. Similarly, the interval between times t4 and t5 during which a current flows through inductance L, and which conditions the duration for voltages VCe and VCo to respectively reach levels dose to levels $V_{OFF}$ and $V_{ON}$, depends on equivalent capacitance $$Ce\left(t5 - t4 = \frac{\pi}{\sqrt{2}} \cdot \sqrt{Ce \cdot L}\right).$$

The same operation is then repeated for the next odd line (times t0', to t2'), etc.

An advantage of this embodiment of the present invention is that it decreases losses by taking advantage of the resonance introduced by inductance L in charge transfer phases. Losses P during this resonance phase can be expressed as:

$$P = f \cdot C_{eq} \cdot \pi \cdot \frac{(V_{ON} - V_{OFF})^2}{4 \cdot \sqrt{2}} \sqrt{\frac{C_{eq}}{L}} \cdot R_{eq},$$

where Ceq=Ce=Co and where Req represents the sum of the resistances of the conductive row lines and of the switches in the on state. In the former example of a 4.7-nF equivalent capacitance Ceq, of a 166-kHz frequency, of a 35-volt voltage $V_{ON}$, and of a −25-volt voltage $V_{OFF}$, and estimating at 20 ohms the total equivalent resistance of the lines, a 0.213-watt loss to be compared with the previously-obtained 1.4 watts is obtained Another advantage of the resonance is that it smoothes switching edges. The value of inductance L (for a given panel) sets the dV/dt This enables decreasing cell-to-cell interferences.

Figure 6:
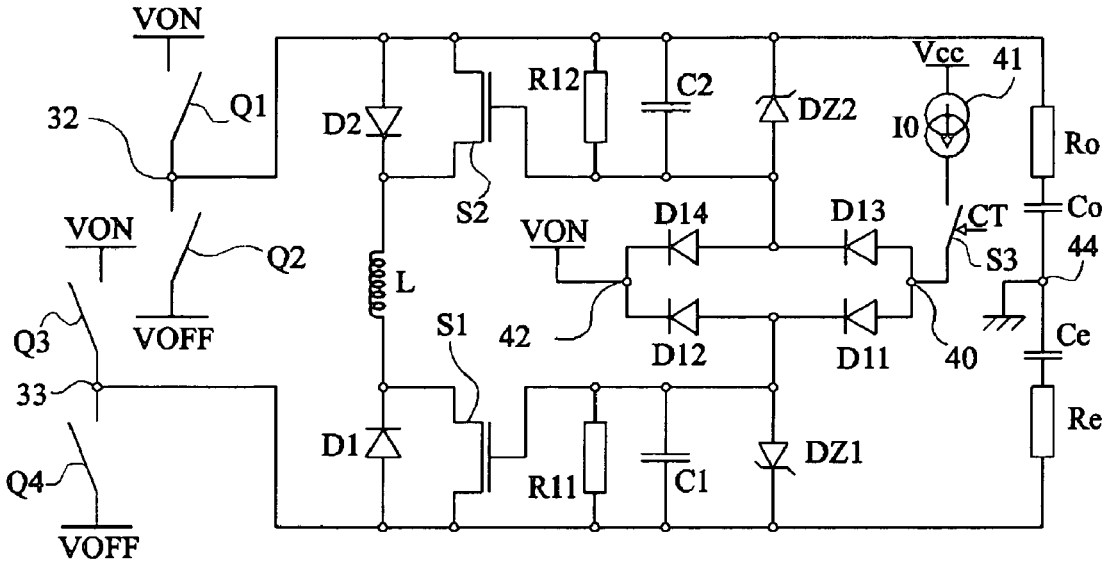
FIG. 6 shows an embodiment of a circuit for controlling the charge transfer switches of the circuit of FIG. 4.

FIG. 6 shows the electric diagram of a circuit for controlling switches S1 and S2 of FIG. 4, here made in the form of MOS transistors. The cells of an even and odd line are symbolized by the respective equivalent capacitances Ce and Co in series with respective resistances Re and Ro between terminals 33, and 32, respectively, and a grounded terminal 44.

The respective gates of transistors S1 and S2 are connected to terminals 33 and 32 by parallel assemblies, each formed of a resistor R11 or R12, of a capacitor C1 or C2 (possibly formed of the gate-source capacitance of transistor S1 or S2), and of a Zener diode DZ1 or DZ2 (or another voltage-limiting element). The function of diodes DZ1 and DZ2 is to protect the gates of transistors S1 and S2. These gates are further connected to the respective junction points of diodes D11 and D12, and D13 and D14, connecting a terminal 40, connected by a switch S3 to a source 41 of a preferably constant current (10), to a terminal 42 of application of voltage $V_{ON}$. Source 41 is supplied by a D.C. voltage Vcc, at least greater than voltage $V_{ON}$ plus the on-state gate-source voltage ($Vgs_{ON}$) of transistor S1 or S2. Diodes D11 to D14 selectively charge the gate of transistor S1 or S2 having its conduction terminal on the side of switches Q at the low level (typically $V_{OFF}$ at the beginning, but the selection operates as long as the voltage is smaller than $V_{ON}$). Resistors R11 and R12 are used to discharge the gates of transistors S1 and S2 in the quiescent state.

Switch S3 is controlled to be turned on at times t1, t4, t1', etc. to initiate the power recovery phases.

Taking the example of time t1, that is, once the addressing of an odd line is over, the turning-on of switch S3 causes the flowing of a current from current source 41 through diode D11 to charge capacitor C1 in parallel on the gate of transistor S1. The flowing to terminal 33 rather than to terminal 32 results from the fact that, on turning-off of switches Q1 and Q3, terminal 32 is approximately at level $V_{ON}$ (at the voltage set by the cells of the odd line) while terminal 32 approximately is at level $V_{OFF}$ (voltage of the cells of the even line). The fact that terminal 42 is at voltage $V_{ON}$ takes part in the blocking of the upper portion (in the arbitrary orientation of the drawing) of the assembly. A current also flows through diode DZ1 to start charging the cells of the even line (Ce, Re).

Once capacitor C1 has reached a sufficient charge, it causes the turning-on of transistor S1. In fact, as compared with the illustration of FIGS. 5A to 5G, this translates as a slight delay (set by the on-state gate-source voltage $Vgs_{ON}$ of transistor S1, the current in source 41, and capacitor C1) on turning-on of switch S1 with respect to time t1. A flowing of the current then establishes from the cells of the odd line (Co, Ro), through diode D2, inductance L, and switch S1, to reach the cells of the next even line (Ce, Re). Transistor S1 remains on as long as the voltage across its gate is positive and is greater than the threshold set by diode DZ1. Switch S3 remains on until capacitor C1 has a sufficient charge (for example, on the order of from 10 to 12 volts). This amounts, for example, to a few hundreds of nanoseconds.

At time t2, the voltage of capacitor C1 plus the voltage between point 33 and the ground becomes sufficient to turn on diode D2. This enables discharge of capacitor C1 and blocking of transistor S1. As soon as switches Q2 and Q3 are turned on (time t3), voltage $V_{ON}$-$V_{OFF}$ between terminals 33 and 32 confirms the blocking of the low portion of the assembly by the discharge of capacitor C1 through diode D12 and switch Q3. Further, the charge of the cells of the even line and the discharge of those of the odd line are carried on.

At the end of the even line cell addressing period (time t4), the voltage of terminal 33 is $V_{OFF}$, that of terminal 32 is $V_{ON}$. Accordingly, a turning-on of switch S3 from time t4 causes the flowing of a charge current of capacitor C2 to turn on transistor S2. An operation similar to that described hereabove for switch S1 is repeated for switch S2.

An advantage of the circuit of FIG. 6 is that it enables controlling both switches S1 and S2 by means of a same control circuit, and thus solving the problems of floating voltages of the conventional circuit (FIG. 3). The control signal of switch S3, which is designated CT in FIG. 6, is, for example, generated by a circuit of control and synchronization (5, FIG. 2) of the screen circuits (generally, of microprocessor type).

As a specific example, a circuit such as illustrated in FIG. 6 may be formed with components having the following values:

L=100 μH;

C1=C2=1 nF;

R 11=R12=100 kΩ; and

DZ1=DZ2=10 Volts.

Figure 7:
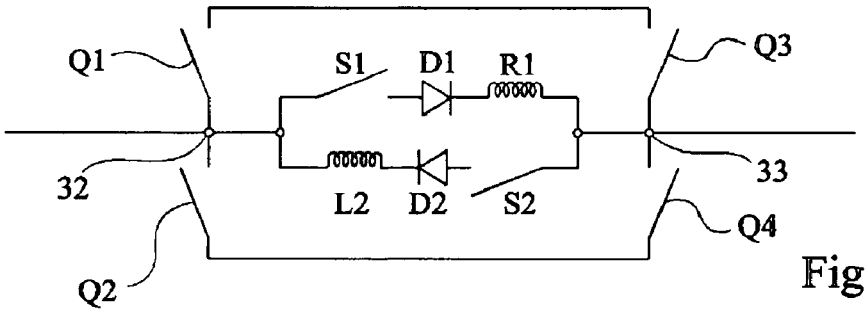
FIG. 7 shows a variation of charge transfer circuit according to an embodiment of the present invention.

FIG. 7 illustrates a variation of the circuit of FIG. 4 according to which two inductive elements L1 and L2 replace the conventional resistors of the assembly of FIG. 3 according to another embodiment of the present invention. Such a variation enables decreasing losses with respect to this conventional assembly of FIG. 3 but it does not enable simplifying the control as in the assembly of FIGS. 4 and 6.

Of course, the present invention and embodiments thereof are likely to have various alterations, modifications, and improvements which will readily occur to those skilled in the art In particular, the sizing of the circuit components according to the screen type (especially its scan frequency and the equivalent capacitances of its cells), is within the abilities of those skilled in the art. Further, the turn-on and turn-off times of the different switching elements which have been shown as being simultaneous may in practice be shifted in time, for example, to avoid simultaneous conduction periods risking short-circuiting the supply lines. Such switching elements arbitrarily designated as switches are in practice MOS transistors (except for switch S3 which is, preferably, a bipolar transistor).

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

Flat screens such as LCD panels including embodiments of the present invention may be contained in a variety of different types of electronic devices, such as portable devices like cellular phones, personal digital assistants (PDAs), calculators, video/audio players, and so on, and may be contained in electronic systems such as computer systems.

The invention claimed is:

1. A charge transfer circuit of a liquid crystal display, comprising:

at least one inductive element connectable between a first and a second common terminals respectively to a first and to a second group of lines of the display, said first and second terminals being connected to the respective junction points of switches connected, in pairs, in series between a third and a fourth terminals of application of high and low line supply voltages; and two switches respectively in parallel with a diode, these parallel associations being in series between said first and second terminals, each switch having a first conduction terminal connected to the inductive element and its control terminal connected to its second conduction terminal by a parallel association of a resistive element, of a capacitive element, and of a voltage-limiting element, the control terminal of each switch being further respectively connected to the midpoints of series associations of diodes connected between a fifth terminal of provision of a control current and said third terminal.

2. The circuit of claim 1, wherein said control current is provided by a current source connected via a third switch to said fifth terminal.

3. The circuit of claim 1, wherein said capacitive element comprises the gate-source capacitance of a MOS transistor forming the corresponding switch.

4. A circuit for controlling a liquid crystal display, comprising the circuit of claim 1.

5. A flat liquid crystal display, comprising the circuit of claim 1.

6. A charge transfer circuit, comprising:

an inductive element having a first node and a second node;

a first diode having a cathode coupled to the first node of the inductive element and having an anode;

a second diode having a cathode coupled to the second node of the inductive element and having an anode;

a first switching element coupled in parallel with the first diode, the first switching element having a first control node;

a second switching element coupled in parallel with the second diode, the second switching element having a second control node;

first and second series-connected switches coupled between first and second supply voltage nodes, with a node defined between the first and second series-connected switches being coupled to the anode of the first diode;

third and fourth series-connected switches coupled between the first and second supply voltage nodes, with a node defined between the third and fourth series-connected switches being coupled to the anode of the second diode;

a first resistive element, first capacitive element, and first voltage-limiting element coupled in parallel across the first control node and anode of the first diode; and a second resistive element, second capacitive element, and second voltage-limiting element coupled in parallel across the second control node and anode of the second diode.

7. The charge transfer circuit of claim 6, wherein each of the first and second switching elements comprises a MOS transistor.

8. The charge transfer circuit of claim 6, wherein the flat screen display is a liquid crystal display.

9. A charge transfer circuit, comprising:

an inductive element having a first node and a second node;

a first diode having a cathode coupled to the first node of the inductive element and having an anode;

a second diode having a cathode coupled to the second node of the inductive element and having an anode;

a first switching element coupled in parallel with the first diode, the first switching element having a first control node;

a second switching element coupled in parallel with the second diode, the second switching element having a second control node;

first and second series-connected switches coupled between first and second supply voltage nodes, with a node defined between the first and second series-connected switches being coupled to the anode of the first diode;

third and fourth series-connected switches coupled between the first and second supply voltage nodes, with a node defined between the third and fourth series-connected switches being coupled to the anode of the second diode;

a first resistive element, first capacitive element, and first voltage-limiting element coupled in parallel across the first control node and anode of the first diode;

a second resistive element, second capacitive element, and second voltage-limiting element coupled in parallel across the second control node and anode of the second diode; and a selective charging circuit connected to the first and second control nodes and operable to selectively charge the capacitive element coupled to the control node of the switching element coupled in parallel with the diode having its anode driven to a low voltage level through an associated one of the series-connected switches.

10. A flat screen display system, comprising:

a flat screen display having even and odd row control lines;

a charge transfer circuit having a first node coupled to the even row control lines and a second node coupled to the odd row control lines of the flat screen display, the charge transfer circuit including, an inductive element connectable between the first and second nodes, and the first and second nodes being connected to the respective junction nodes of two series-connected switches connected between a first supply node and a second supply node adapted to receive high and low supply voltages, respectively; and first and second switching circuits coupled in parallel with first and second diodes, respectively, these parallel-connected switching circuits and diodes being coupled in series with the inductive element between the first and second nodes, each switching circuit having a first conduction node connected to the inductive element and a control node connected to a second conduction node of the switching circuit through a parallel-connected resistive element, capacitive element, and voltage-limiting element, the control node of each switching circuit further connected to a node at an interconnection of a corresponding pair of series-connected diodes connected between the a current node adapted to receive a control current and the first supply node.

11. The flat screen display system of claim 10, wherein the flat screen display comprises a liquid crystal display.

12. The charge transfer circuit of claim 9, wherein the selective charging circuit comprises:

a first pair of series-connected diodes having an anode of a first one of the diodes connected to a current source node and a cathode of the other one of the diodes connected to the first supply voltage node;

a second pair of series-connected diodes having an anode of a first one of the diodes connected to the current source node and a cathode of the other one of the diodes connected to the first supply voltage node;

a current source having a first node and a second node adapted to receive a third supply voltage greater than the first supply voltage on the first supply voltage node; and a switching element interconnecting the first node of the current source to the current source node.

13. The charge transfer circuit of claim 12, wherein the current source comprises a constant current source.

14. The charge transfer circuit of claim 12, wherein each of the first and second switching elements comprises a MOS transistor and wherein the third supply voltage has a value that is greater than the first supply voltage plus a threshold voltage of these MOS transistors.

* * * * *

UNITED STATES PATENT AND TRADEMARK OFFICE

CERTIFICATE OF CORRECTION

PATENT NO. : 7,821,480 B2
APPLICATION NO. : 11/648173
DATED : October 26, 2010
INVENTOR(S) : Benoit Peron et al.

It is certified that error appears in the above-identified patent and that said Letters Patent is hereby corrected as shown below:

- In Claim 10, Column 10, Line 18 of the patent, please change the text "connected between the a" to -- connected between a --.

Signed and Sealed this
Twenty-ninth Day of March, 2011

David J. Kappos

David J. Kappos
*Director of the United States Patent and Trademark Office*